US007329070B1

(12) United States Patent
Trent et al.

(10) Patent No.: US 7,329,070 B1
(45) Date of Patent: Feb. 12, 2008

(54) RAM-TYPE TENSIONER ASSEMBLY WITH ACCUMULATORS

(75) Inventors: David Trent, Cypress, TX (US); Robert M. Shivers, III, Houston, TX (US); William T. Bennett, Jr., Houston, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 0 days.

(21) Appl. No.: 11/694,680

(22) Filed: Mar. 30, 2007

(51) Int. Cl.
*E21B 15/02* (2006.01)

(52) U.S. Cl. ..... 405/224.4

(58) Field of Classification Search ..... 405/224.4
See application file for complete search history.

(56) References Cited

U.S. PATENT DOCUMENTS 4,883,387 A * 11/1989 Myers et al. ..... 405/224.4
5,551,803 A * 9/1996 Pallini et al. ..... 405/223.1
6,190,089 B1 2/2001 Bennet, Jr. et al.
7,008,340 B2 3/2006 William et al.
7,112,011 B2 9/2006 McCarty et al.
7,131,922 B2 11/2006 Williams et al.
2006/0254776 A1* 11/2006 Williams ..... 166/355

* cited by examiner

*Primary Examiner*—John Kreck
(74) *Attorney, Agent, or Firm*—Buskop Law Group, PC; Wendy Buskop

(57) ABSTRACT

A tensioner assembly having a fully extended position, a fully retracted position and a plurality of extended positions there between, for supporting a riser extending downwardly from a platform to a subsea wellhead. The tensioner assembly can have a riser conductor portion, a tension disk, a lower support structure, a plurality of ram tensioner piston rods, a cylinder deck, a plurality of hydraulic stroke cylinders, a plurality of first primary accumulators, a plurality of second primary accumulators, a plurality of first valves, a plurality of secondary accumulators, and a plurality of second valves.

19 Claims, 10 Drawing Sheets

RAM-TYPE TENSIONER ASSEMBLY WITH ACCUMULATORS

FIELD

The present embodiments relate generally to tensioners for marine risers. More particularly, the present embodiments relate to the use of hydraulic and pneumatic cylinders for tensioning marine risers.

BACKGROUND

Hydropneumatic tensioners exist in the art, namely, those cited and further described in U.S. Pat. No. 7,112,011.

A problem with existing hydropneumatic tensioners is the required use of fluid separators between accumulators. Fluid separators not only add weight and cost to the equipment but have a tendency to clog, becoming unreliable, as well as to deteriorate through use and require costly and time-consuming maintenance cycles.

Tensioners additionally have the problem of being overly complex, thereby increasing the cost and time required for maintenance, as well as the cost and manufacturing time of the equipment.

There exists a need for a tensioner that is not overly complex and is easy to maintain.

The present embodiments meet these needs.

BRIEF DESCRIPTION OF THE DRAWINGS

The detailed description will be better understood in conjunction with the accompanying drawings as follows.

Figure 1:
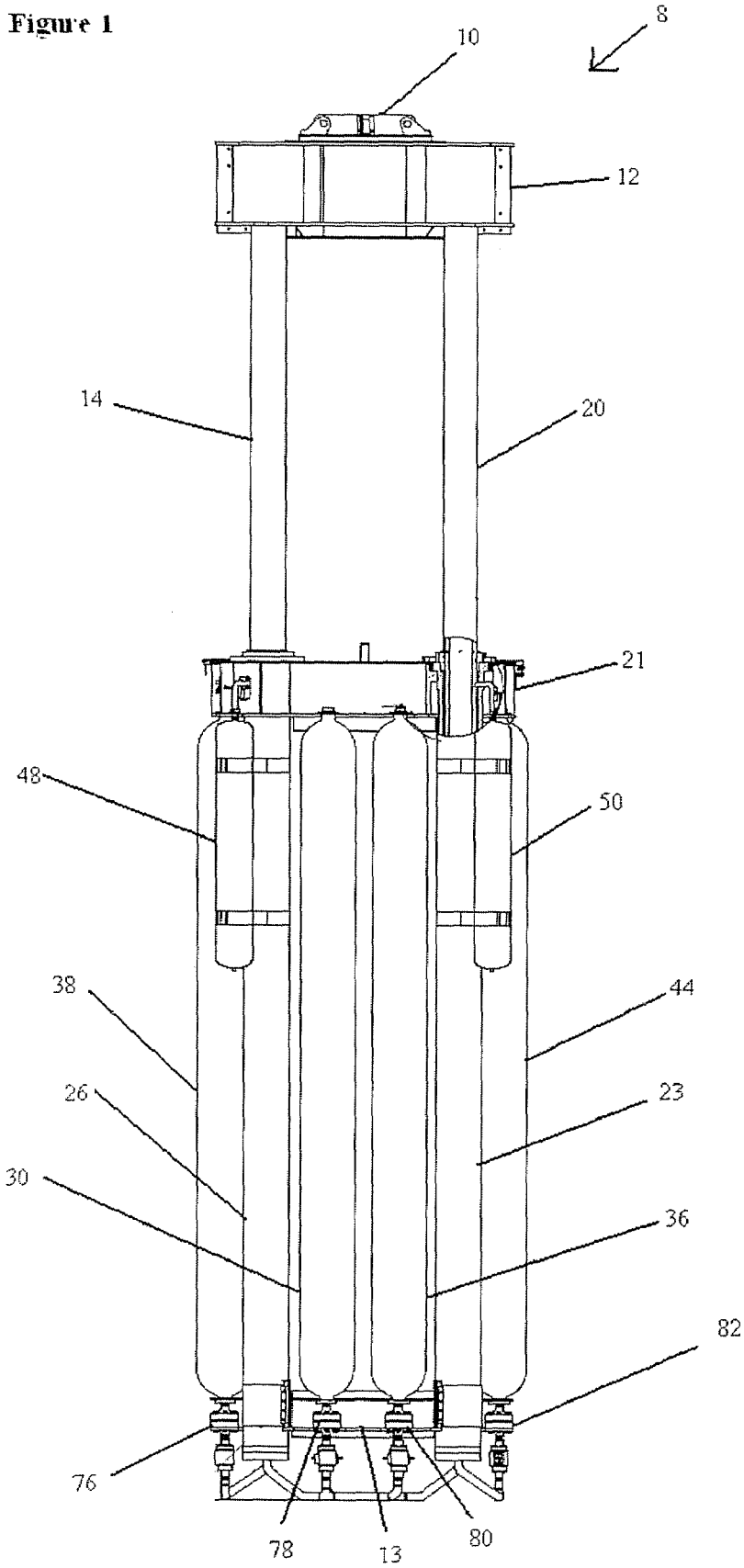
FIG. 1 is a side view of an embodiment of a tensioner assembly according to the invention.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

The invention comprises elements that, when assembled, form a unitary integral tensioner assembly for use on a tension leg platform with a short stroke, a deep draft cassion vessel (such as a Spar™), a drill ship, a work boat, or a semisubmersible.

The tensioner assembly of the present invention can be used to replace air cans and direct acting tensioning systems.

Further variations of the tensioner assembly can be utilized in both drilling and production riser applications.

The tensioner assembly of the present invention is operated by hydraulic fluid stroke cylinders. Lubricating fluid, stored inside one or more low pressure secondary accumulators, can lubricate individual pistons in individual hydraulic stroke cylinders. The hydraulic stroke cylinders are energized by higher pressure compressible gas from one or more primary accumulators. The hydraulic stroke cylinders are uniquely connected in a one-to-one relationship with a primary accumulator, rather than connecting a single primary accumulator with multiple hydraulic stroke cylinders.

The tensioner assembly is easily built with simple design parts that are easily interchangeable. There is not a need to purchase specially made parts to manufacture the tensioner assembly. The tensioner assembly additionally has only a few sealing areas, lowering the need for costly maintenance cycles, since there are fewer seals to deteriorate.

The tensioner assembly has at least one valve between each hydraulic stroke cylinder and each connected primary accumulator.

In one embodiment, the tensioner assembly only uses one large primary accumulator connected to each hydraulic stroke cylinder, such as by a manifold piping assembly.

In another embodiment, the tensioner assembly can use two smaller primary accumulators, connected together by a manifold and valve arrangement, and then to the hydraulic stroke cylinder.

The addition of valves allows for individual primary accumulators to be easily replaced by shutting off the valves, without requiring disassembly of the entire tensioner assembly.

Additionally, the tensioner assembly's stiffness can be easily adjusted. A stand pipe can be placed inside each primary accumulator for altering the volume of space inside each primary accumulator when fluid is added. The benefit of designing a primary accumulator in such a fashion is that one standard size primary accumulator can be used for a variety of applications, while the stiffness of the tensioner assembly can still be easily modified, as needed, for any individual application.

The invention relates to a tensioner assembly having a fully extended position, a fully retracted position and a plurality of extended positions there between, for supporting a riser extending downwardly from a platform or floating vessel to a subsea wellhead.

The tensioner assembly includes a conductor for guiding and sliding supporting a riser from a subsea well. The tensioner assembly provides upward riser support. The tensioner assembly provides riser support when the rig is in motion, particularly vertical support for the riser. The conductor can support risers having a diameter ranging from 21 inches to 4 inches.

The tensioner assembly has a tensioner disk with a pass thru diameter ranging from 70 inches to 36 inches.

A plurality of ram tensioner piston rods extend from the tensioner disk on one end and into hydraulic stroke cylinders that are connected on the other end. The hydraulic stroke cylinders are also connected to a lower support structure.

A cylinder deck with cylinder deck holes for receiving each ram tensioner piston rod connects to the hydraulic stroke cylinders. The ram tensioner piston rods move slidingly through the cylinder deck holes, enabling the tensioner disk to move with the rods away from the cylinder deck to a fully extended position, or to retract for a fully collapsed position, or any of a number of positions therebetween the fully extended and fully retracted positions.

The hydraulic stroke cylinders can be secured slidingly or flexibly to the cylinder deck and slidingly or flexibly to the lower support structure on the opposite end.

A first primary accumulator engages each of the hydraulic stroke cylinders and forms a fluid communication for emitting a first pressurized gas, such as nitrogen into the hydraulic stroke cylinder, enabling the ram tensioner piston to extend away from the hydraulic stroke cylinder.

In another embodiment, a second primary accumulator can be in fluid communication with one of the first primary accumulators and the related hydraulic stroke cylinder for providing a continuous gas on demand to the hydraulic stroke cylinder via a manifold.

A valve is located between each primary accumulator and a manifold to the hydraulic stroke cylinders. The valve can be connected to control means, to shut off gas flow into the hydraulic cylinders and thereby isolating gas to the hydraulic stroke cylinder, which is a significant safety benefit and very useful for repair or replacement of accumulators. These valves are primarily shut off valves. The valves can be connected to a control means for automated shut off.

Secondary accumulators are in fluid communication with each hydraulic stroke cylinder. A secondary accumulators can generally be smaller than a primary accumulators. The secondary accumulators can be secured on one end to a hydraulic stroke cylinder, such as by piggy back, or to the cylinder deck.

Each secondary accumulators each have a safety valve between the secondary accumulator and the hydraulic stroke cylinder. The safety valve can be a valve such as a spring loaded dummy valve. The safety valve can be a poppet valve adapted to close when a certain amount of pressure due to fluid flow occurs on the valve. The secondary accumulator can be responsible for providing lubricating fluid to the hydraulic stroke cylinder.

The tensioner disk rides on at least two tracks using a moveable slidable assembly that can be plurality of rollers engaging each track allowing the ram tensioner pistons to easily extend and retract. Alternatively, the moveable slidable assembly can be wear pads or bushings.

FIG. 1 depicts a side view of a tensioner assembly 8 according to the invention. A tensioner ring 10 is shown connected to the tensioner disk 12. The tensioner disk 12 supports between 4 and 12 ram tensioner piston rods. In the embodiment of FIG. 1, only two ram tensioner piston rods are shown, 14 and 20 in this side view.

The ram tensioner piston rods slide through a cylinder deck 21 having at least 4 holes, each hole enabling a ram tensioner piston rod to slide through the cylinder deck.

On the cylinder deck opposite where the ram tensioner piston rods 14 and 20 meet the cylinder deck, there are an equivalent number of sliding engaged hydraulic stroke cylinders. Four hydraulic stroke cylinders are contemplated by this embodiment, and two are shown in this view, namely, first hydraulic stroke cylinder 23 and third hydraulic stroke cylinder 26.

Each hydraulic stroke cylinder is contemplated to support a pressure ranging from 15 psi to 4000 psi.

Each hydraulic stroke cylinder is contemplated to use a lubricating fluid such as water based glycol type mixture, a white oil, a peanut oil, an environmentally friendly oil that passes the United States Environmental Protection Agency "Shrimp Test" of 2006, a hydraulic oil, or other type of lubricating fluid.

The hydraulic stroke cylinders are supported on the ends opposite the cylinder deck 21 with a lower support structure 13.

The lower support structure 13 not only supports the hydraulic stroke cylinders 23 and 26, but also supports at least one primary accumulator, which in this embodiment is depicted as first and second primary accumulators 30 and 36 which are in fluid communication with hydraulic stroke cylinders 26 and 23 respectively.

The total volume of the first primary accumulator and second primary accumulator is determined based on the required stiffness of the system.

Additionally, this Figure suggests a first primary accumulator 44 connects to a second primary accumulator (not shown) for providing fluid to the hydraulic stroke cylinder 23. A first primary accumulator 38 similarly connects to a second primary accumulator for providing fluid to hydraulic stroke cylinder 26.

A first secondary accumulator 48 is shown for providing fluid, such as hydraulic fluid to the hydraulic stroke cylinder 26. A second secondary accumulator 50 is shown for providing fluid to the hydraulic stroke cylinder 23.

Port 76 is the second primary accumulator port for engaging a hydraulic stroke cylinder not shown. Port 78 is the first primary accumulator port for engaging hydraulic stroke cylinder 26. Port 80 is the second primary accumulator port for engaging hydraulic stroke cylinder 26, and Port 82 is the first primary accumulator port for engaging hydraulic stroke cylinder 23 for flowing pressurized gas to the hydraulic stroke cylinders.

Figure 2:
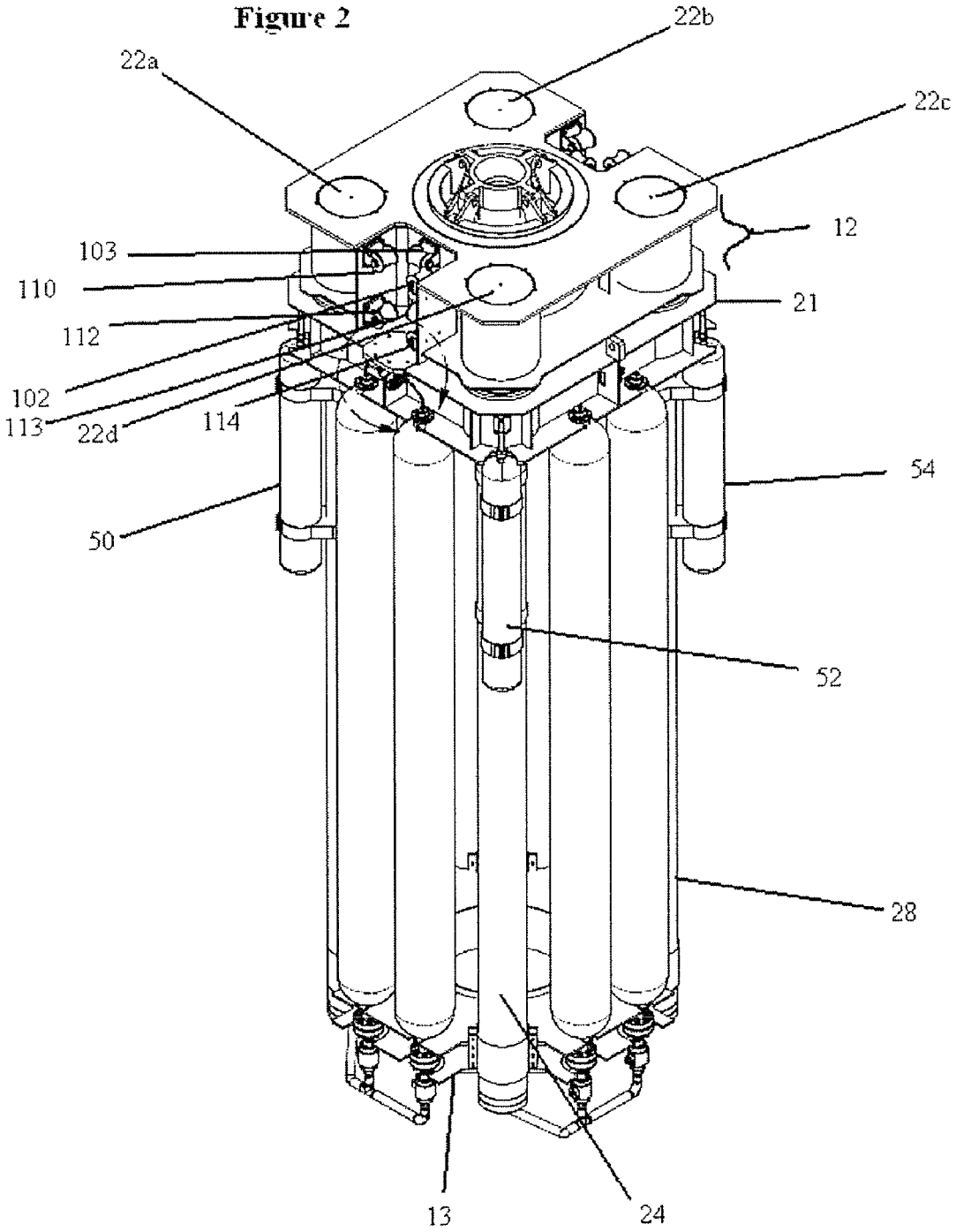
FIG. 2 is a partial top perspective view of the tensioner assembly.

FIG. 2 is a partial top perspective view of the tensioner assembly of FIG. 1. In this view the tensioner disc 12 can be more easily viewed with the four holes 22*a*, 22*b*, 22*c*, and 22*d* depicted for receiving the ram tensioner piston rods. FIG. 2 further depicts cylinder deck 21.

Also in this view, three of the four secondary accumulators, 50, 52, and 54 are depicted. Each secondary accumulator is connected to a hydraulic stroke cylinder. Also shown is lower support structure 13.

The second hydraulic stroke cylinder 24 and hydraulic stroke cylinder 28 are shown connected to the lower support structure 13.

Figure 10:
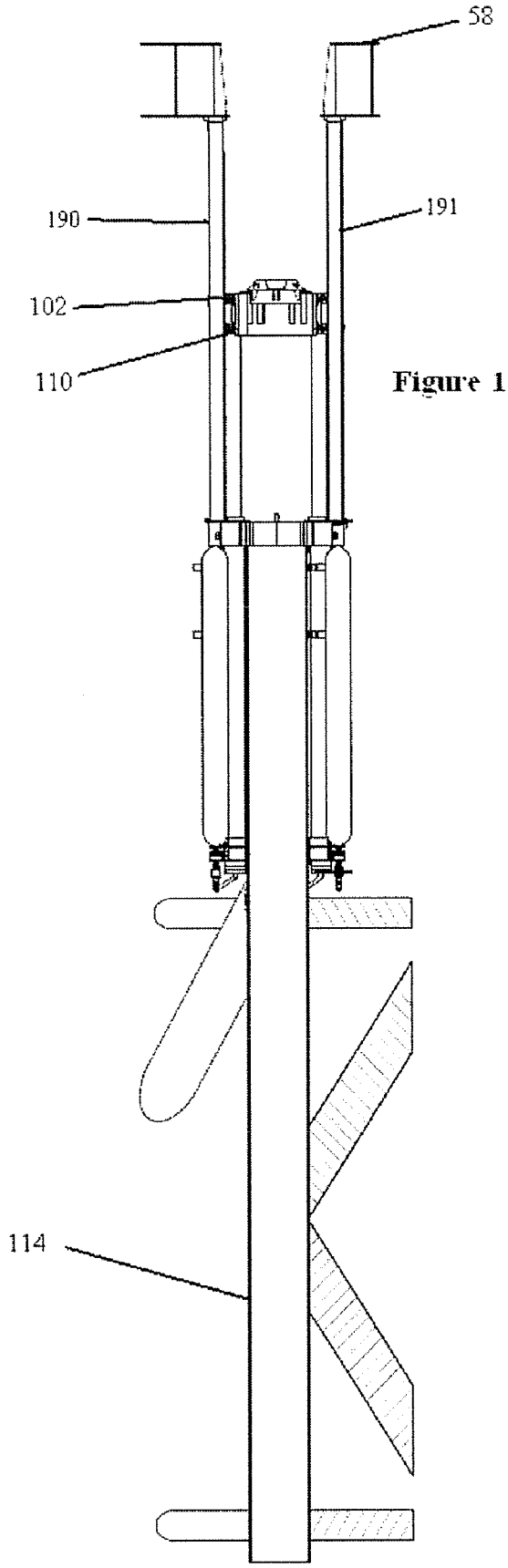
FIG. 10 shows a cross section of the tensioner assembly installed on a conductor.

FIG. 2 also shows first rollers 102, 103 and 110 for engaging a track not shown in this view, but depicted in FIG. 10.

In FIG. 2, a second set of rollers can be located beneath the first set of rollers for enhanced stability and resistance to eccentric load, sway, yaw and pitch. That second set of rollers are shown as 112, 113, 114. Rollers 113 and 114 are not shown in this view.

It is preferred that the rollers grab the track on three sides for enhanced security and significant reduction of movement and stability of the tensioner disc and other tensioner equipment. This flexibility with security is a significant feature of this design.

Figure 3:
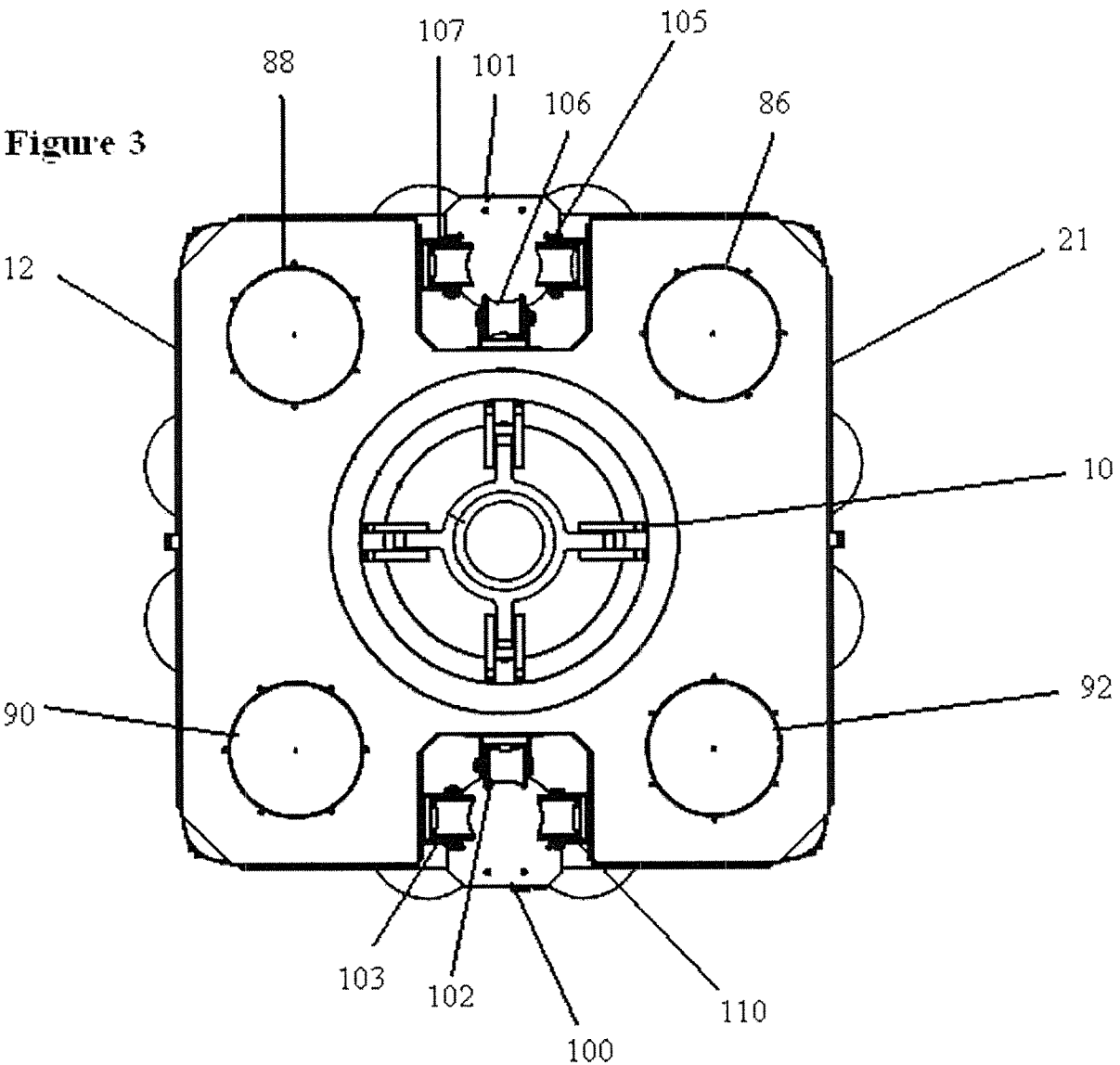
FIG. 3 is a plan view of the tensioner assembly.

FIG. 3 is a top view of the tensioner assembly. In this top view four cylinder rod receivers for the ram tension piston rods are shown as 86, 88, 90, and 92. These rod receivers are depicted in a square orientation, each receiver at a corner of the tensioner disk 12.

Track mounting bases 100 and 101 are shown. Rollers 102, 103, 110 roll on the track shown in FIG. 10. Rollers 105, 106, and 107 roll on a second track, shown in FIG. 10. The tension ring 10 is also shown.

Figure 4:
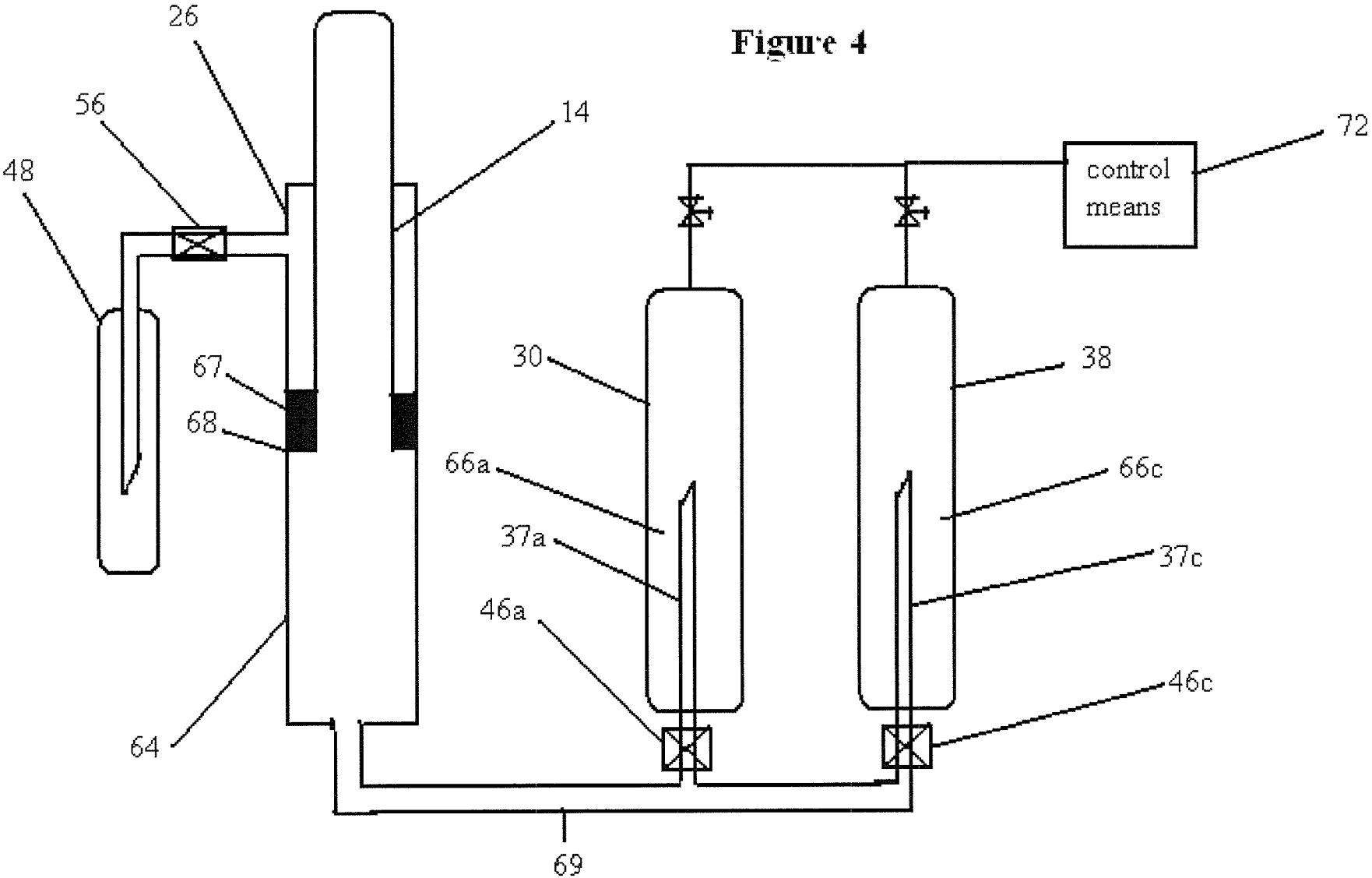
FIG. 4 is a cross sectional schematic view of the tensioner assembly.

FIG. 4 depicts a cross sectional schematic of the tensioner assembly of FIG. 1. In this embodiment a first primary accumulator 30 is shown connected to a second primary accumulator 38 via a pipe 69. Two valves 46*a* and 46*c* are placed between the accumulators and the pipe 69. These valves can be stop valves to turn off the assembly and stop fluid flow between the hydraulic stroke cylinder and primary accumulators 30 and 38. This may be necessary when the primary accumulators need to be replaced.

Inside the primary accumulators are stand pipes 37*a* and 37*c* that can be used to allow fluid adjustment to increase the stiffness of the assembly. The primary accumulators 30 and 38 are controlled by control means 72.

The primary accumulators 30 and 38 engage a bore 64 through the pipe 69. The bore 64 receives a first fluid 66*a* from the first primary accumulator 30 and a second fluid 66*c* from the second primary accumulator 38. The first fluid 66*a* and the second fluid 66*c* can be a gas, such as nitrogen, at a range from 15 psi to 4,000 psi.

A secondary accumulator 48 is depicted connected to hydraulic stroke cylinder 26 having a ram tensioner piston rod 14 extending therefrom. A valve 56 is placed between secondary accumulator 48 and hydraulic stroke cylinder 26. Valve 56 can be a check valve, a stop valve, a spring-loaded valve, a poppet valve, a safety valve, or similar valves. The hydraulic stroke cylinder 26 contains lubricating fluid 67 between hydraulic stroke cylinder 26 and piston rod 14. A seal 68 separates lubricating fluid 67 from the first fluid 66*a* and the second fluid 66*c*.

Figure 5:
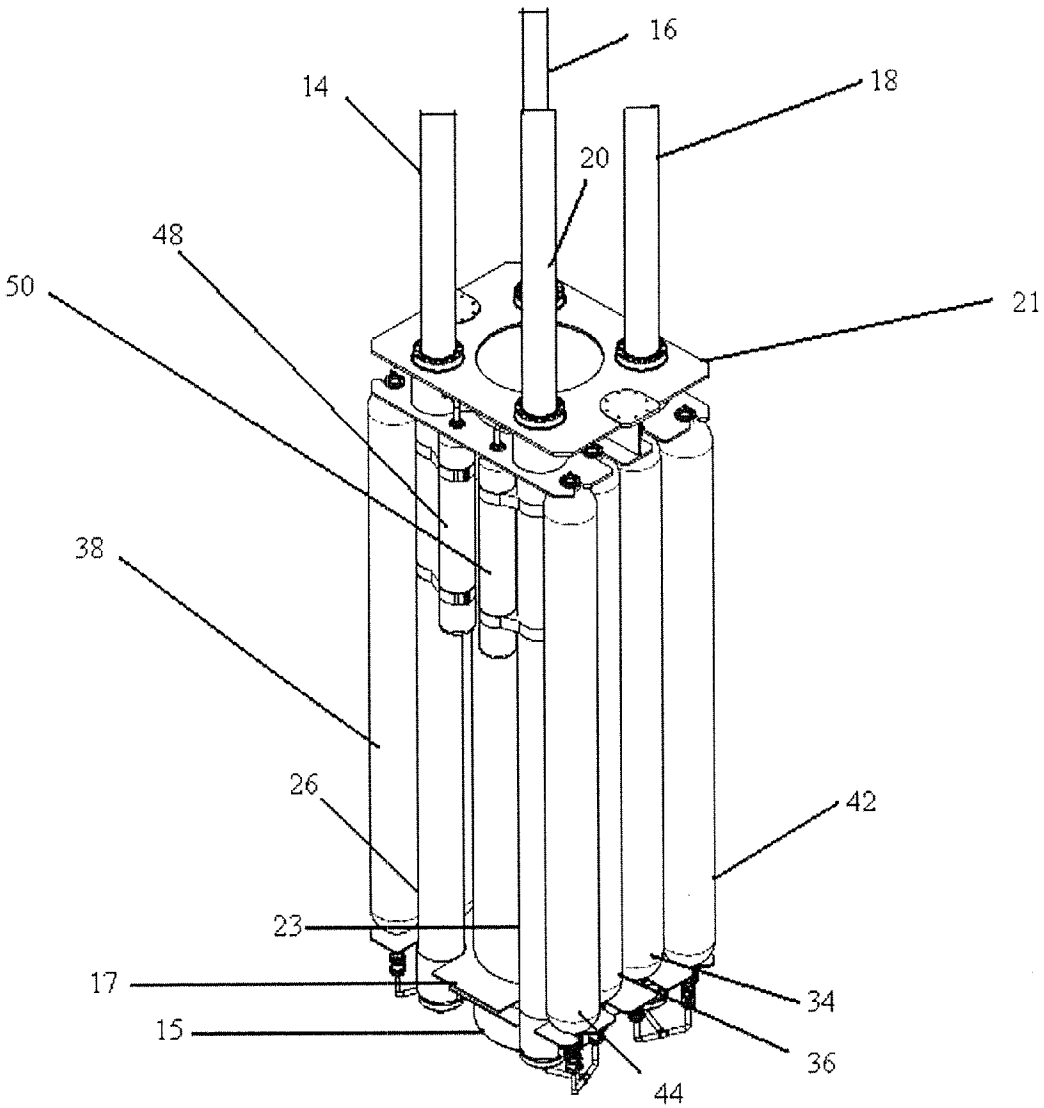
FIG. 5 is a partial perspective view of the tensioner assembly.

FIG. 5 is a partial perspective view of the tensioner assembly of FIG. 1. In this view, four ram tensioner piston rods are depicted 14, 16, 18 and 20 respectively. The rods are shown passing through the cylinder deck 21 into the hydraulic stroke cylinders although only 23, and 26 are shown. The hydraulic stroke cylinders engage the lower support which is made up of a conductor portion 15 connected to a support plate 17. Two secondary accumulators are shown, 48 and 50. The first secondary accumulator 48 is grouped with first primary accumulator 38 and hydraulic stroke cylinder 26. Secondary accumulator 50 is grouped with hydraulic stroke cylinder 23 and first primary accumulator 44 and second primary accumulator 36.

The secondary accumulator 48 engages hydraulic stroke cylinder 26, and the secondary accumulator 50 engages hydraulic stroke cylinder 23. Secondary accumulator 48 and secondary accumulator 50 are smaller in size than the primary accumulators.

The support plate 17 also supports the various primary accumulators depicted as 34, 36, 38, 42, and 44.

Figure 6:
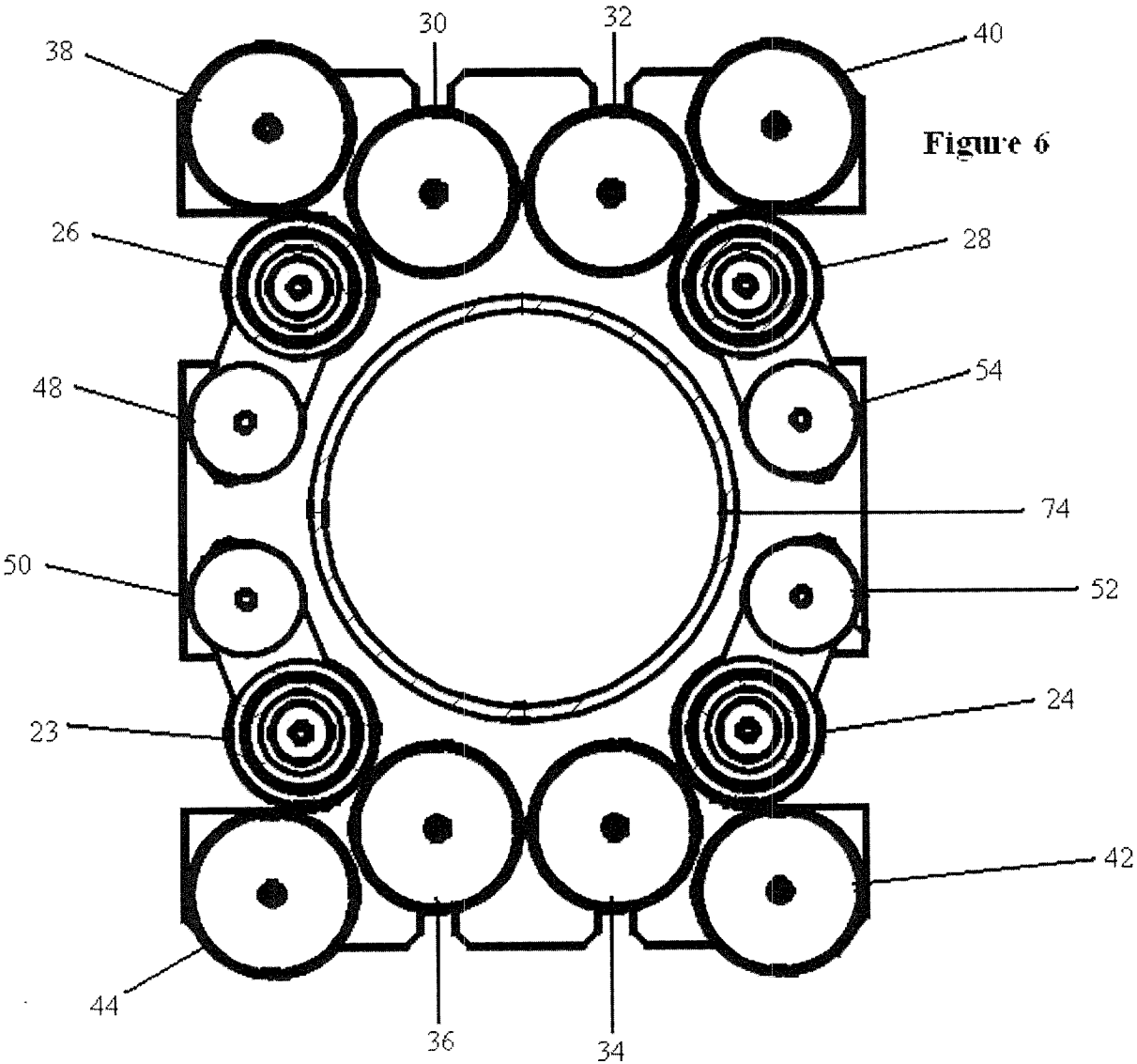
FIG. 6 is a cross sectional plan view of the tensioner assembly.

FIG. 6 is a top view of a cross section depiction of an orientation of the cylinders for the tensioner assembly as well as the accumulators. These elements are disposed around a central tubular housing 74 which is used to contain a riser.

There are shown four hydraulic stroke cylinders, 23, 24, 26, and 28. Cylinder 23 is fluidly connected to primary accumulators 36 and 44, cylinder 24 is fluidly connected to primary accumulators 34 and 42. Cylinder 28 is fluidly connected to primary accumulators 32 and 40, and cylinder 26 is supported by primary accumulators 30 and 38. Cylinder 24 is supported by primary accumulators 34 and 42.

It should be noted that more than 4 cylinders could be used if more than 4 piston rods are used.

Secondary accumulators are depicted as well, as 48, 50, 52 and 54 respectively.

Figure 7:
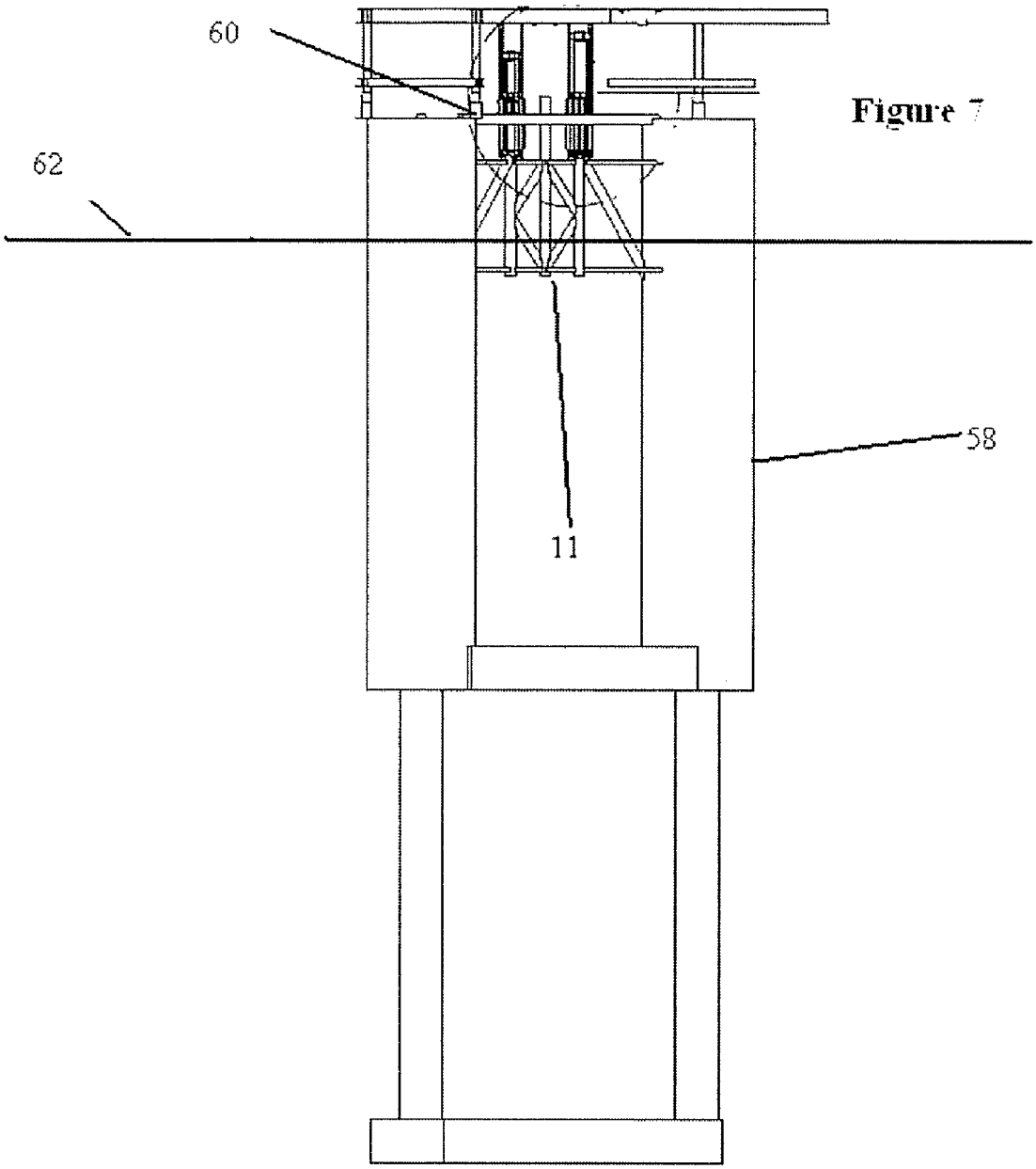
FIG. 7 shows the tensioner assembly installed on a semisubmersible drilling rig.

FIG. 7 shows the tensioner assembly of FIG. 1 on a semisubmersible production/drilling platform 58. However, this system could be used on a tension leg platform (TLP), a deep draft cassion vessel (SPAR), a fixed leg platform, or a drill ship.

In this embodiment, the waterline of the vessel is shown as 62, (sea level) and the tensioner assembly is depicted as residing on the conductor 11 of the rig.

Figure 8:
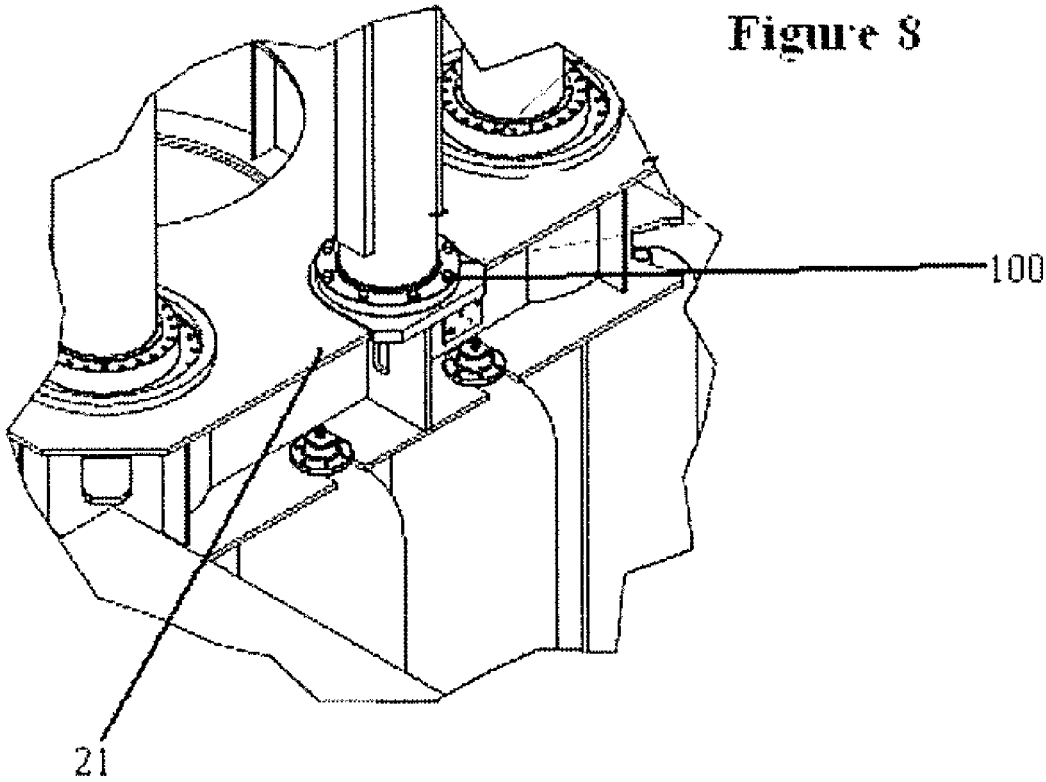
FIG. 8 shows a detail of a support plate of the tensioner assembly.

FIG. 8 shows a detail of the cylinder deck of the tensioner assembly wherein the hydraulic stroke cylinders further have a track on at least two sides for guiding the tension deck. The tracks interface with the vessel an also allow a path for control lines and monitoring cables used by the control means 72, depicted in FIG. 4, and other devices. The track is shown having a track base 100 connected to the cylinder deck 21.

Figure 9:
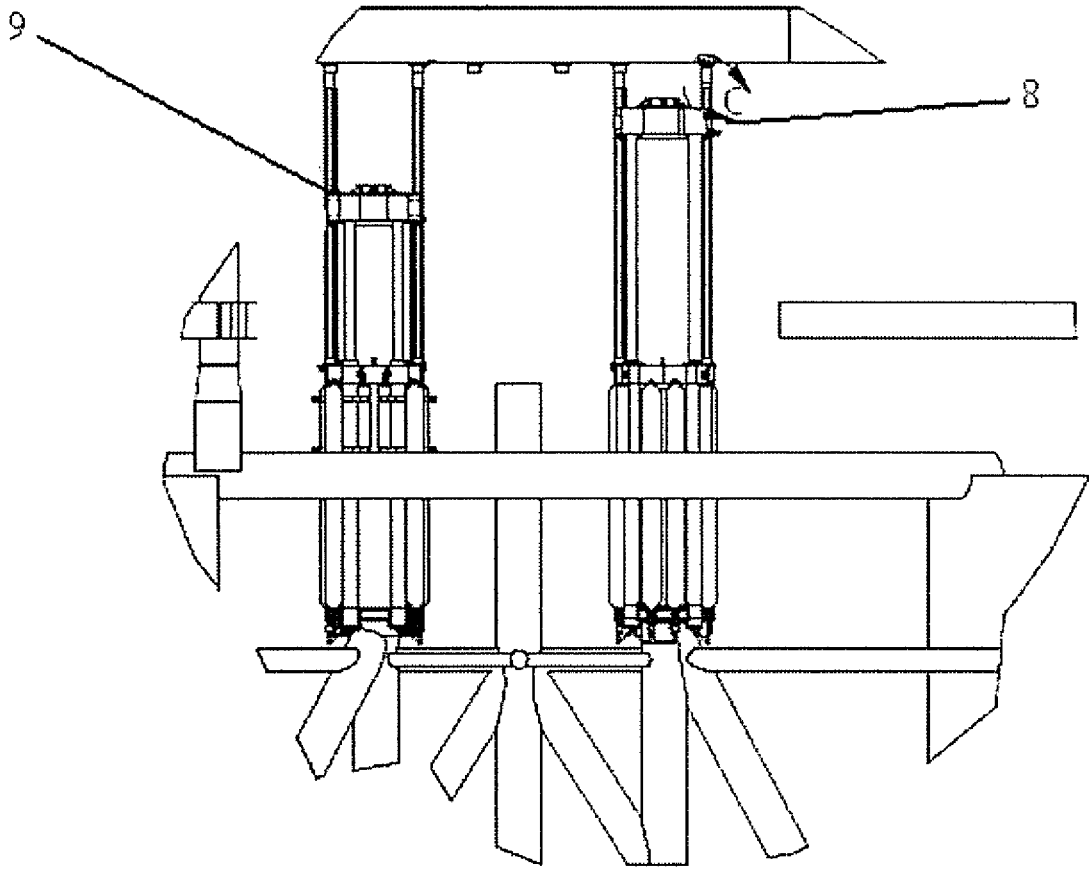
FIG. 9 shows a dual tensioner assembly for a drilling rig.

FIG. 9 depicts an embodiment of two tensioner assemblies used in tandem on a production/drilling rig, namely first tensioner assembly 8 and second tensioner assembly 9.

The hydraulic stroke cylinder and ram tensioner piston rod can be formed out of any material known to persons of ordinary skill in the art. Certain materials are contemplated for use herein, including carbon steel, stainless steel, aluminum, and titanium. It is contemplated that the ram tensioner piston rod and hydraulic stroke cylinder be made from a light weight material that helps to reduce the overall weight of the tensioner assembly and helps to eliminate friction.

The assembly has been designed to reduce the potential for electrolysis and galvanic action causing corrosion.

FIG. 10 shows the tensioner assembly with the conductor 114 which is secured to the cylinder deck enabling the riser to travel safely within the conductor 114 while providing stability from waves and other waterline movement of the vessel, such as yaw, pitch and sway. The conductor 114 is contained within the center part of the tensioner and is surrounded by the cylinders and accumulators. In this Figure, the tracks 190 and 191 are also more clearly depicted and secured to the platform 58. Rollers 103 and 113 are shown holding the tensioner disk on the track 100.

In operation, the tensioner disk moves up and down along the track that is secured to the cylinder deck and production platform and moves on the rollers. The rollers can be hard rubber, metal wheels or a composite material, over a stiff core. The rollers can be steel, nylon, composites of steel and nylon, and polyurethane. At least 3 wheels are used per track in a T configuration, but 6 wheels per track can be used and up to 9 wheels per track are contemplated.

The conductor can be a hollow tube or conduit which is made from strong but light steel, aluminum, which can be reinforced material, or concrete. In an embodiment, the conductor extends below the waterline of the platform with a smooth bore.

The tensioner assembly of the present invention may be utilized to compensate for offset of an oil drilling vessel connected to a riser. For example, the tensioner assembly is placed or disposed in communication with an oil production/drilling vessel and the riser which extends through the ocean from a subsea well.

Additionally, an oil drilling vessel may be stabilized using the tensioner assembly of the present invention by maintaining and adjusting tension in the cylinder by maintaining and adjusting the pressure in the cylinder by placing the cylinder and gas source in communication with at least one control source.

It is to be understood that the invention is not limited to the exact details of construction, operation, exact materials or embodiments shown and described as obvious modifications and equivalents will be apparent to one skilled in the art. For example, the hydraulic stroke cylinder may include only one port, and the valve can be one of several different types of valves. Also, the tensioner assembly may be assembled using bolts, welding, or any other device or method known to persons of ordinary skill in the art. Moreover, the individual components may be manufactured out of any material and through any method known to persons of ordinary skill in the art, though steel is the preferred material and nitrogen is a preferred gas.

While these embodiments have been described with emphasis on the embodiments, it should be understood that within the scope of the appended claims, the embodiments might be practiced other than as specifically described herein.

What is claimed is:

1. A tensioner assembly having a fully extended position, a fully retracted position and a plurality of extended positions therebetween, for supporting a riser extending downwardly from a platform to a subsea wellhead, wherein the tensioner assembly comprises:

a tension disk connected to a riser conductor portion having a moveable guiding, stabilizing assembly for slidably engaging a first track and a second track attachable to the platform for preventing lateral movement of the tensioner assembly due to yaw, pitch, roll and sway of a vessel;

a lower support structure for slidably and laterally supporting a plurality of hydraulic stroke cylinders;

a plurality of ram tensioner piston rods wherein each of the plurality of ram tensioner piston rods engages the tension disk on one end;

a cylinder deck securely supporting the first track and the second track and comprising a plurality of cylinder deck holes, wherein each of the plurality of cylinder deck holes has a diameter sufficient to enable slidable engagement with one of the plurality of hydraulic stroke cylinders;

wherein the plurality of hydraulic stroke cylinders are slidingly secured to the cylinder deck on one end and to the lower support structure on the opposite end, and wherein the plurality of hydraulic stroke cylinders is concentrically disposed around the downwardly extending riser from the riser conductor portion, and wherein each of the plurality of hydraulic stroke cylinders is adapted for receiving one of the plurality of ram tensioner piston rods;

a plurality of primary accumulators wherein each of the plurality of primary accumulators is connected to the cylinder deck and wherein each of the plurality of primary accumulators is in fluid communication with one of the plurality of hydraulic stroke cylinders in a one-to-one connection and wherein each of the plurality of primary accumulators has a volume dependant on a desired stiffness of the plurality of ram tensioner piston rods;

a plurality of secondary accumulators, each in fluid communication with one of the plurality of hydraulic stroke cylinders in a one-to-one connection, and wherein each of the plurality of secondary accumulators is secured to one of the plurality of hydraulic stroke cylinders;

a conductor fixedly secured to the lower support structure for slidably and removeably containing the riser from the subsea well;

a plurality of valves, wherein each of the plurality of valves is disposed between one of the plurality of secondary accumulators and one of the plurality of hydraulic stroke cylinders; and wherein the tension disk can move from a fully retracted position to a fully extended position and a plurality of positions therebetween using the moveable guiding, stabilizing assembly engaging the first track and the second track and preventing lateral movement of the tension disk due to yaw, pitch, roll and sway of the vessel.

2. The tensioner assembly of claim 1, wherein the conductor is non-removeably secured to the cylinder deck.

3. The tensioner assembly of claim 1, wherein the moveable guiding, stabilizing assembly comprises a plurality of rollers engaging the first track and the second track to prevent lateral movement of the tension disk.

4. The tensioner assembly of claim 1, wherein the moveable guiding, stabilizing assembly comprises a plurality of pads for engaging the first track and the second track or a cylinder with a bushing ring around the cylinder to prevent lateral movement of the tension disk.

5. The tensioner assembly of claim 1, further comprising: a plurality of second primary accumulators, each in fluid communication with one of the plurality of primary accumulators and one of the plurality of hydraulic stroke cylinders; and a plurality of second valves, wherein each of the plurality of second valves is disposed between one of the plurality of primary accumulators and one of the plurality of second primary accumulators.

6. The tensioner assembly of claim 1, wherein the riser conductor portion is additionally fixedly secured to the cylinder deck for slidably containing the riser and a support plate disposed around the conductor portion for supporting the plurality of hydraulic stroke cylinders and the plurality of primary accumulators.

7. The tensioner assembly of claim 5, wherein at least one of the plurality of second valves comprises a member of the group consisting of a block valve or a shut off valve.

8. The tensioner assembly of claim 1, wherein at least one of the plurality of valves is a spring loaded dummy valve or a poppet valve.

9. The tensioner assembly of claim 1, wherein each of the plurality of hydraulic stroke cylinders comprises a bore for receiving a first compressible fluid from one of the plurality of primary accumulators and a second non compressible fluid from one of the plurality of secondary accumulators.

10. The tensioner assembly of claim 9, wherein the first compressible fluid is a pressurized gas and the second non-compressible fluid is a member of the group consisting of: a lubricating fluid, a white oil, a hydraulic fluid, a fluid for use on an offshore vessel that passes the United States Environmental Protection Agency "shrimp test" for 2006, a biodegradable lubricating oil, a peanut oil, a brake fluid, a water glycol fluid mixture, or combinations thereof.

11. The tensioner assembly of claim 9, wherein the first compressible fluid is nitrogen, a nitrogen and air mixture, air, air and helium mixture, or combinations thereof.

12. The tensioner assembly of claim 1, wherein the riser is slidably secured within the conductor.

13. The tensioner of claim 3, wherein the plurality of rollers comprise steel, a polyamide, a composite of steel and a polyamide, polyurethane, or combinations thereof.

14. The tensioner of claim 13, wherein each of the plurality of rollers are hollow or solid.

15. The tensioner of claim 1, wherein the conductor comprises a member of the group, steel, aluminum, composite, concrete, or combinations thereof.

16. The tensioner of claim 15, wherein the conductor extends below a waterline of the platform.

17. The tensioner assembly of claim 1, further comprising at least one track base mounted to the cylinder deck and the first track or the second track for providing control lines and monitoring cables to the plurality of hydraulic stroke cylinders without entangling the control lines during extension and retraction of the plurality of ram tensioner piston rods.

18. The tensioner assembly of claim 1, wherein the tensioner assembly is usable to support a riser from a drill ship, a semisubmersible, a work board, a tension leg platform with a short stroke, a deep draft cassion vessel, or combinations thereof.

19. The tensioner assembly of claim 1, wherein the first track and the second track are attachable to the tensioner assembly.

* * * * *